US007488416B2

(12) United States Patent
Chen

(10) Patent No.: US 7,488,416 B2
(45) Date of Patent: Feb. 10, 2009

(54) BATHING POOL ASSEMBLY WITH WATER FULL OF NANO-SCALE OZONE BUBBLES FOR REHABILITATION

(75) Inventor: Kuo-Kang Chen, Taipei (TW)

(73) Assignee: Rosace International Co., Ltd., Taipei (TW)

( * ) Notice: Subject to any disclaimer, the term of this patent is extended or adjusted under 35 U.S.C. 154(b) by 122 days.

(21) Appl. No.: 11/702,456

(22) Filed: Feb. 5, 2007

(65) Prior Publication Data

US 2008/0184472 A1 Aug. 7, 2008

(51) Int. Cl.
*A47K 3/02* (2006.01)
*C02F 1/78* (2006.01)
*A61H 33/14* (2006.01)

(52) U.S. Cl. ..... 210/167.11; 210/206; 4/222; 4/538

(58) Field of Classification Search ..... 210/167.01, 210/167.1, 167.11, 167.12, 198.1, 205, 206; 4/222, 488, 489, 538
See application file for complete search history.

(56) References Cited

U.S. PATENT DOCUMENTS 4,375,812 A 3/1983 Vaseen et al.
5,834,031 A 11/1998 Martin et al.
2002/0139755 A1 10/2002 Green et al.
2004/0154998 A1 8/2004 Minnix
2005/0279713 A1* 12/2005 Osborn et al. ..... 210/760
2007/0154364 A1* 7/2007 Tseng et al. ..... 422/186.07
2007/0163935 A1 7/2007 Chewins

FOREIGN PATENT DOCUMENTS

GB 2 402 066 12/2004
JP 62-160116 * 7/1987
JP 4-180891 * 6/1992
JP 11-019657 1/1999

OTHER PUBLICATIONS

Written Opinion and Search Report of Application No. SG 200700946-7, filed Feb. 8, 2007.*

* cited by examiner

*Primary Examiner*—Fred Prince
(74) *Attorney, Agent, or Firm*—Alan Kamrath; Kamrath & Associates PA

(57) ABSTRACT

A bathing pool assembly with water full of nano-scale ozone bubbles for rehabilitation has a bath, a reservoir and two circulating systems. The bath and the reservoir both have a main inlet and a main outlet. The reservoir further has a tap to allow water to flow out of the reservoir, which is provided for people to drink or gargle. The circulating systems are connected respectively to and communicate respectively with the bath and the reservoir to recycle water. The circulating systems are further connected to a gas generator assembly having an oxygen generator and an ozone generator to provide water full of oxygen and ozone to release free radicals and anions.

6 Claims, 1 Drawing Sheet

BATHING POOL ASSEMBLY WITH WATER FULL OF NANO-SCALE OZONE BUBBLES FOR REHABILITATION

BACKGROUND OF THE INVENTION

1. Field of Invention

The present invention relates to a bathing pool assembly with water full of nano-scale ozone bubbles for rehabilitation and, more particularly, to a bathing pool assembly that has water full of nano-scale ozone bubbles and that saves water to prevent germs from infecting a person when he is taking a bath and also to provide potable water without germs.

2. Description of the Related Art

Because the oxidizing ability of ozone is 300 times more than that of chlorine, ozone can kill more germs than chlorine does. Thus, ozone dissolved in water is used to kill germs. Water with dissolved ozone is usually used to clean skin especially a burned wound to facilitate the burned wound to recover. For a person having a weak resistance against disease, water with dissolved ozone not only can be used to clean his body, but also can be drunk to raise a cure rate.

If water is emulsified to generate multiple bubbles, water will release anions from the bubbles to kill germs after the bubbles burst. Because dental instruments usually propagate germs such as *Pseudomonas aeruginosa*, fluorescent *pseudomonads*, Amebae, hepatitis A virus, hepatitis B virus, human immunodeficiency virus and other *bacillus* that may infect patients, emulsified water with ozone can be used to wash the dental instruments or be used to gargle in a person's mouth. The emulsified water with ozone can kill germs, adhering to the dental instruments or the person's mouth cavity, in a few minutes. Thus, the person or the patients are not easily infected by germs.

However, tap-water passing through pipes and a water tower that are not cleaned frequently will result in tap-water full of germs. Moreover, it is not convenient for people to obtain water with ozone or emulsified water with ozone in their daily lives. Thus, people, especially elders and children who have a weak resistance against disease, will be infected easily by germs.

Furthermore, many people go to a public bathroom to clean their bodies. However, the public bathroom has a capacity of many people and has many long pipes, so germs such as *Staphylococcus* propagates more easily give rise to many diseases, for example, a disease of the urinary system, septicemia, pneumonia and other dermatitis. Therefore, if the public bathroom has no desirable sterilizing device, people's health will be damaged.

Additionally, water can not be used repeatedly after a person takes a bath, so water will be wasted.

To overcome the shortcomings, the present invention provides a bathing pool assembly with water full of nano-scale ozone bubbles for rehabilitation to mitigate or obviate the aforementioned.

SUMMARY OF THE INVENTION

The primary objectives of the present invention is to provide a bathing pool assembly with water full of nano-scale ozone bubbles for rehabilitation that can save water to prevent germs from infecting a person when he is taking a bath and also to provide potable water without germs.

To achieve the objectives, the bathing pool assembly with water full of nano-scale ozone bubbles for rehabilitation in accordance with the present invention has a bath, a reservoir and two circulating systems. The bath has a main inlet and a main outlet. The reservoir has a main inlet, a main outlet and a tap. The tap allows water to flow out of the reservoir, which is provided for people to drink or gargle. The circulating systems are connected respectively to and communicate respectively with the bath and the reservoir to recycle water. The circulating systems are connected to a gas generator having an oxygen generator and an ozone generator. Each circulating system has a filter, a high-pressure pump, a constant voltage regulator and a high-pressure emulsifying apparatus to provide water full of oxygen and ozone to release free radicals and anions.

Therefore, people can obtain emulsified water with ozone in their daily life to wash their bodies or to drink or gargle. Furthermore, water can be recycled by the circulating systems.

Other objectives, advantages and novel features of the invention will become more apparent from the following detailed description when taken in conjunction with the accompanying drawings.

DETAILED DESCRIPTION OF THE INVENTION

Figure 1:
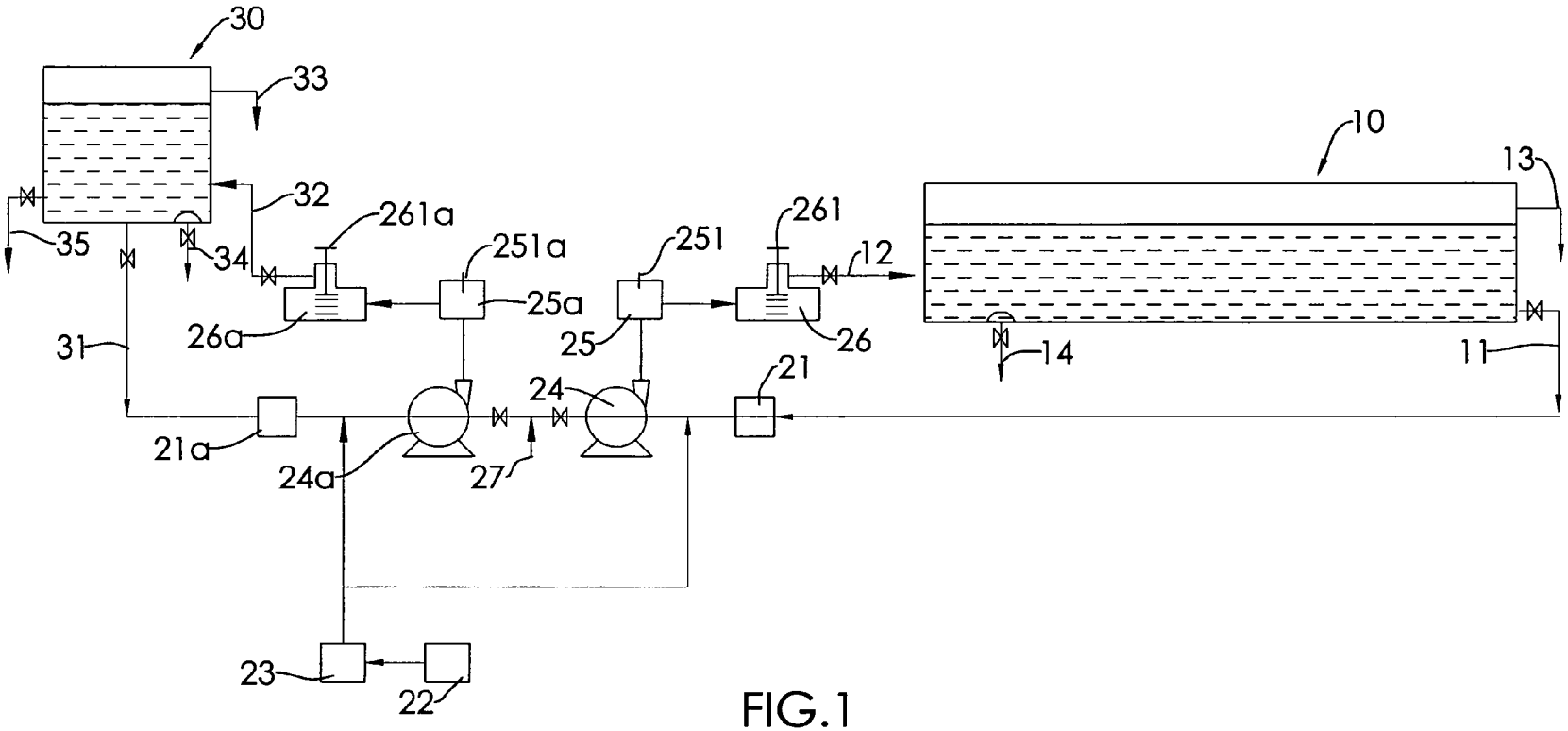
FIG. 1 is a deployment diagram of a bathing pool assembly with water full of nano-scale ozone bubbles for rehabilitation in accordance with the present invention.

With reference to FIG. 1, a bathing pool assembly with water full of nano-scale ozone bubbles for rehabilitation in accordance with the present invention has a bath (10), a reservoir (30), a gas generator assembly and two circulating systems.

The bath (10) has a side, a top, a bottom, an inner space, a main inlet (12), a main outlet (11), a spillway (13) and a drain pipe (14). The bath (10) may connect and communicate with another bath. The main inlet (12) is mounted on the bath (10) and communicates with the inner space to allow water to flow in the bath (10) and may have a valve. The main outlet (11) is mounted on the bath (10) and communicates with the inner space to allow water to flow out of the bath (10) and may have a valve. The spillway (13) is mounted on the side and near the top of the bath (10) and communicates with the inner space to allow water to flow out of the bath (10) to regulate a water level. The drain pipe (14) is mounted on the bottom of the bath (10) and communicates with the inner space to allow water to flow out of the bath (10) and may have a valve or a stopper.

The reservoir (30) has a side, a top, a bottom, an inner space, a main inlet (32), a main outlet (31), a spillway (33), a drain pipe (34) and a tap (35). The reservoir (30) may connect and communicate with another reservoir. The main inlet (32) is mounted on the reservoir (30) and communicates with the inner space to allow water to flow in the reservoir (30) and may have a valve. The main outlet (31) is mounted on the reservoir (30) and communicates with the inner space to allow water to flow out of the reservoir (30) and may have a valve. The spillway (33) is mounted on the side and near the top of the reservoir (30) and communicates with the inner space to allow water to flow out of the reservoir (30) to regulate a water level. The drain pipe (34) is mounted on the bottom of the reservoir (30) and communicates with the inner space to allow water to flow out of the reservoir (30) and may have a valve or a stopper. The tap (35) is mounted on the reservoir (30) and communicates with the inner space to allow water to flow out of the reservoir (30), which is provided for people to drink or gargle.

The gas generator assembly has an oxygen generator (22) and an ozone generator (23). The oxygen generator (22) generates oxygen and may be a pressure swing adsorption (PSA) type oxygen generator. The ozone generator (23) is connected to and communicates with the oxygen generator (22) via a pipe and obtains oxygen from the oxygen generator (22) to generate ozone.

One of the circulating systems is connected to the bath (10) and the other is connected to the reservoir (30). The two circulating systems are connected to the gas generator assembly. Each circulating system has a filter (21, 21*a*), a high-pressure pump (24, 24*a*), a constant voltage regulator (25, 25*a*) and a high-pressure emulsifying apparatus (26, 26*a*).

The filter (21, 21*a*) is connected to and communicates with the main outlet (11, 31) of one of the bath (10) and the reservoir (30) to filter hair, fur or the like in the bath (10) or sewage in the reservoir (30) and allows water in the bath (10) or the reservoir (30) to flow in the circulating system to recycle.

The high-pressure pump (24, 24*a*) is connected to and communicates with the filter (21, 21*a*) of one of the bath (10) and the reservoir (30) by a pipe. The pipe is connected to and communicates with the ozone generator (23) to allow the oxygen and ozone to transport from the oxygen generator (22) and the ozone generator (23) to the high-pressure pump (24, 24*a*). The oxygen and ozone dissolved in water will release free radicals to destroy RNA and DNA of microorganisms to kill germs. An amount of oxygen in water is 70 ppm while 10 ppm is a normal amount of oxygen in water, and 40-60 ppm is an amount of oxygen in water pressed by a high pressure without an oxygen generator. Amounts of ozone in water of the bath (10) and the reservoir (30) are respectively 0.5-5 mg/l and 0.2-0.5 mg/l. The high-pressure pumps (24, 24*a*) of the circulating systems communicate with each other by a communicating pipe. The communicating pipe has a tap-water inlet (27) and two valves. The tap-water inlet (27) allows water to flow in the circulating systems. Each valve is mounted between one of the high-pressure pumps (24) and the tap-water inlet (27) to control the tap-water to flow in either or both systems.

The constant voltage regulator (25, 25*a*) is connected to and communicates with the high-pressure pump (24, 24*a*) and may have an air-releasing valve (251, 251*a*) to control a pressure of water.

The high-pressure emulsifying apparatus (26, 26*a*) is connected to and communicates with the constant voltage regulator (25, 25*a*) by a pipe and is also connected to and communicates with the main inlet (12, 32) of the bath (10) or the reservoir (30). The high-pressure emulsifying apparatus (26, 26*a*) generates a pressure of 3-10 atm to dissolve ozone in water rapidly to form multiple nano-scale ozone bubbles (so called "cavitation") that looks like multiple layers of barriers. Each bulbs bubble has a diameter at a range of 10-20 nanometer, and the bubbles will release 50,000 to 100,000 anions/ml. The bubbles will burst in the bath (10) and the reservoir (30), so a clean effect of the bubbles in the present invention is more effective and steady than that of a general ultrasonic vibrator. Furthermore, the present invention can have the clean effect without high frequency of the general ultrasonic vibrator. The high-pressure emulsifying apparatus (26, 26*a*) may have a controlling valve (261, 261*a*) to control the pressure of water into the bath (10)/reservoir (30).

When users use the bath (10) for the first time, they can turn on the valve of the tap-water inlet (27) and the circulating system for the bath (10) to allow water to fill in the bath (10) and wait for about 10 minutes to allow water in the bath (10) to be emulsified and full of oxygen and ozone after circulating. Thus, oxygen, free radicals of ozone and anions of the emulsified bubbles will contact the user's skin and even permeate into the user's pores (may form an ion channel) to kill germs.

When users want to drink water or gargle, they can turn on the valve of the tap-water inlet (27) and the circulating system for the reservoir (30) to allow water to fill in the reservoir (30) and also wait for about 10 minutes to allow water in the reservoir (30) to be emulsified and full of oxygen and ozone after circulating. Because free radicals and anions will kill germs in water, people drink the water. Even when people gargle with the emulsified water with ozone and oxygen, germs in their mouth cavity will also be killed.

Therefore, people can obtain emulsified water with ozone in their daily life to wash their bodies or to drink or gargle. Furthermore, water can be recycled by the circulating systems.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A bathing pool assembly with water full of nano-scale ozone bubbles for rehabilitation having a bath having
- a side;
- a top;
- a bottom;
- an inner space;
- a main inlet mounted on the bath and communicating with the inner space;
- a main outlet mounted on the bath and communicating with the inner space;
- a spillway mounted on the side and near the top of the bath and communicating with the inner space; and
- a drain pipe mounted on the bottom of the bath and communicating with the inner space;

a reservoir having
- a side;
- a top;
- a bottom;
- an inner space;
- a main inlet mounted on the reservoir and communicating with the inner space of the reservoir;
- a main outlet mounted on the reservoir and communicating with the inner space of the reservoir;
- a spillway mounted on the side and near the top of the reservoir and communicating with the inner space of the reservoir;
- a drain pipe mounted on the bottom of the reservoir and communicating with the inner space of the reservoir; and
- a tap mounted on the reservoir and communicating with the inner space of the reservoir;

a gas generator assembly having
- an oxygen generator generating oxygen;
- an ozone generator connected to and communicating with the oxygen generator via a pipe and generating ozone; and
- two circulating systems, one circulating system connected to the bath, the other circulating system connected to the reservoir, with each circulating system having a filter connected to and communicating with the main outlet of one of the bath and the reservoir;

a high-pressure pump connected to and communicating with the filter of one of the bath and the reservoir by a pipe that communicates with the ozone generator, wherein the high-pressure pumps of the circulating systems communicate with each other by a communicating pipe that has a tap-water inlet; and two valves and each valve mounted between one of the high-pressure pumps and the tap-water inlet;

a constant voltage regulator connected to and communicating with the high-pressure pump; and a high-pressure emulsifying apparatus connected to and communicating with the constant voltage regulator by a pipe and also connected to and communicating with the main inlet.

2. The bathing pool assembly with water full of nano-scale ozone bubbles for rehabilitation as claimed in claim 1, wherein each constant voltage regulator has an air-releasing valve.

3. The bathing pool assembly with water full of nano-scale ozone bubbles for rehabilitation as claimed in claim 2, wherein each high-pressure emulsifying apparatus has a controlling valve.

4. The bathing pool assembly with water full of nano-scale ozone bubbles for rehabilitation as claimed in claim 3, wherein the main inlet of the bath has a valve;

the main outlet of the bath has a valve;

the drain pipe of the bath has a stopper;

the main inlet of the reservoir has a valve;

the main outlet of the reservoir has a valve; and the drain pipe of the reservoir has a stopper.

5. The bathing pool assembly with water full of nano-scale ozone bubbles for rehabilitation as claimed in claim 1, wherein each high-pressure emulsifying apparatus has a controlling valve.

6. The bathing pool assembly with water full of nano-scale ozone bubbles for rehabilitation as claimed in claim 1, wherein the main inlet of the bath has a valve;

the main outlet of the bath has a valve;

the drain pipe of the bath has a stopper;

the main inlet of the reservoir has a valve;

the main outlet of the reservoir has a valve; and the drain pipe of the reservoir has a stopper.

* * * * *